US006282735B1

(12) United States Patent
Stolpmann et al.

(10) Patent No.: US 6,282,735 B1
(45) Date of Patent: Sep. 4, 2001

(54) HYDROTHERAPY BED

(75) Inventors: James R. Stolpmann; Kenneth R. Smith, both of Charleston; Roger D. Dalton, Moncks Corner; Gary W. Ferdon, Charleston; Jonathan H. Mueller, Mt. Pleasant, all of SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/378,796

(22) Filed: Aug. 23, 1999

(51) Int. Cl.[7] ..... A61G 7/02; A47C 27/18

(52) U.S. Cl. ..... 5/606; 5/604; 5/695; 5/710; 5/713; 5/740

(58) Field of Search ..... 5/606, 928, 709, 5/710, 713, 724, 727, 699, 926, 604, 695, 671, 925, 739, 740; 4/480; 1/482

(56) References Cited

U.S. PATENT DOCUMENTS

| | | | | |
|---|---|---|---|---|
| 183,973 | * | 10/1876 | Rhodes | 5/695 X |
| 793,061 | * | 6/1905 | Dugan | 5/604 |
| 899,361 | * | 9/1908 | Wassam | 5/604 X |
| 1,604,205 | * | 10/1926 | Tiffany | 5/695 |
| 1,949,035 | * | 2/1934 | Beurschgens | 5/604 X |
| 2,656,549 | * | 10/1953 | Oshon, Jr. | 5/604 X |
| 3,909,858 | * | 10/1975 | Ducker | 5/713 |
| 4,011,610 | * | 3/1977 | Parker, III | 5/604 |
| 4,042,988 | * | 8/1977 | Holliday | 5/710 |
| 4,319,781 | * | 3/1982 | Tsuge | 5/925 X |
| 4,682,378 | * | 7/1987 | Sovenije | 5/710 X |
| 4,864,669 | * | 9/1989 | Jones | 5/925 X |
| 4,947,500 | * | 8/1990 | Seiler | 5/713 |
| 5,101,527 | * | 4/1992 | Wadsworth, III et al. | 5/727 |
| 5,189,745 | * | 3/1993 | Workman et al. | 5/709 X |
| 5,249,319 | * | 10/1993 | Higgs | 5/713 X |
| 5,269,030 | | 12/1993 | Pahno et al. | 5/604 |
| 5,325,551 | * | 7/1994 | Toppel et al. | 5/709 |
| 5,419,347 | | 5/1995 | Carruth | 134/57 R |
| 5,421,044 | * | 6/1995 | Steensen | 5/710 |
| 5,438,721 | | 8/1995 | Pahno et al. | 5/604 |
| 5,588,167 | | 12/1996 | Pahno et al. | 5/606 |
| 5,702,536 | | 12/1997 | Carruth | 134/10 |
| 5,802,646 | | 9/1998 | Stolpmann et al. | 5/740 |
| 5,815,865 | | 10/1998 | Washburn et al. | 5/713 |
| 5,991,949 | * | 11/1999 | Miller, Sr. et al. | 5/710 |
| 6,073,290 | * | 6/2000 | Miller, Sr. | 5/710 |
| 6,115,861 | * | 9/2000 | Reeder et al. | 5/926 X |
| 6,178,578 | * | 1/2001 | Saltani et al. | 5/713 |
| 6,212,718 | * | 4/2001 | Stolpmann, et al. | 5/713 |

FOREIGN PATENT DOCUMENTS

| | | | | |
|---|---|---|---|---|
| 17357 | * | 3/1882 | (DE) | 5/695 |
| 374328 | * | 6/1932 | (GB) | 5/604 |

* cited by examiner

*Primary Examiner*—Michael F. Trettel
*Assistant Examiner*—Robert G. Santos
(74) *Attorney, Agent, or Firm*—Rose McKinney & Evans LLP

(57) ABSTRACT

A hydrotherapy mattress assembly which includes an air-over-foam core, a base for receiving the air-over-foam core, and a top cover overlying the air-over-foam core. The top cover provides a patient support surface and includes a drain trough. The drain trough is coupled to a drain which extends through the air-over-foam core and the base, so that liquids can be drained from the patient support surface.

30 Claims, 9 Drawing Sheets

HYDROTHERAPY BED

BACKGROUND AND SUMMARY OF THE INVENTION

The present invention relates to a mattress assembly and particularly, to a mattress assembly for use on a hospital bed. More particularly, the present invention relates to a mattress assembly that can be used to provide hydrotherapy to a patient lying or sitting on the mattress assembly.

The treatment of bedridden patients in hospitals, nursing homes and other care facilities can require that they be washed after urination or bowl movement and otherwise washed on a periodic basis. The washing of bedridden patients is frequently performed using sponge baths. While sponge baths are somewhat effective, they are not as effective as emersion or spray baths. In the case of bedridden patients immersion or spray baths can be impractical.

The present invention provides for a mattress assembly which can be used to provide hydrotherapy to a bedridden or non-ambulatory patient.

According to other features, characteristics, embodiments and alternatives of the present invention which will become apparent as the description thereof proceeds below, the present invention provides a hydrotherapy mattress assembly which includes an air-over-foam core, a base for receiving the air-over-foam core, and a top cover which covers the air-over-foam core and provides a patient receiving surface. The top cover is provided with a drain trough which extends through a central portion of the top cover. The apparatus also includes a liquid drain coupled to the drain trough. The air-over-foam core is provided with a through-hole through which the liquid drain extends.

The present invention further provides a hydrotherapy mattress having a liquid drain system which includes an air-over-foam core having a through-hole located in a central location thereof, and a base for receiving the air-over-foam core. The base includes a drain passage. The apparatus also includes a top cover for covering the air-over-foam core. The top cover provides a patient receiving surface. The apparatus further includes a drain trough located in the top cover, and a drain coupled to the drain trough and extending through the through-hole in the air-over-foam core and through the drain passage in the bottom of the base.

BRIEF DESCRIPTION OF DRAWINGS

The present invention will be described hereafter with reference to the attached drawings which are given as non-limiting examples only, in which.

DETAILED DESCRIPTION OF THE DRAWINGS

The present invention is directed to a hydrotherapy bed which includes a hydrotherapy mattress assembly. The hydrotherapy mattress assembly includes a base that can be supported on a standard stationary or articulating bed frame, a table, or other support surface. The hydrotherapy mattress assembly includes an air-over-foam core which is received in the base, and a top cover which overlies the air-over-foam core. The top cover which can be made from a liquid-impervious material defines a patient supporting surface and includes a drain trough. The drain trough in coupled to a drain which can extend downward though the air-over-foam core and out the base.

Liquids, such as patient cleaning solutions, disinfectant solutions, medical solutions, etc, can be applied to the patient supporting surface and drained therefrom through the drain trough and drain. For example, patients supported by the hydrotherapy mattress assembly could be washed by a hand-held spraying means, and the residual liquid could be drained away through the drain trough and drain.

According to additional embodiments of the invention, the mattress assembly can include a perimeter inflater positioned over the air-over-foam core. When inflated, the perimeter inflater can contain liquids by forming a barrier at the periphery of the mattress assembly.

The hydrotherapy mattress assembly can also include an inner cover between the top cover and the air-over-foam core. The inner cover can be made of a material having a low coefficient of friction and thereby allow for independent movement of a patient with respect to the air-over-foam core. For example, the use of an inner cover having a low coefficient of friction would allow the air-over-foam core to articulate with an underlying articulating bed support, while allowing a patient supported on the top cover to slide rather than move with the articulating motion.

The hydrotherapy mattress assembly can also include a bottom storage cover which can be coupled to the top cover and used to store the mattress assembly.

Figure 1:
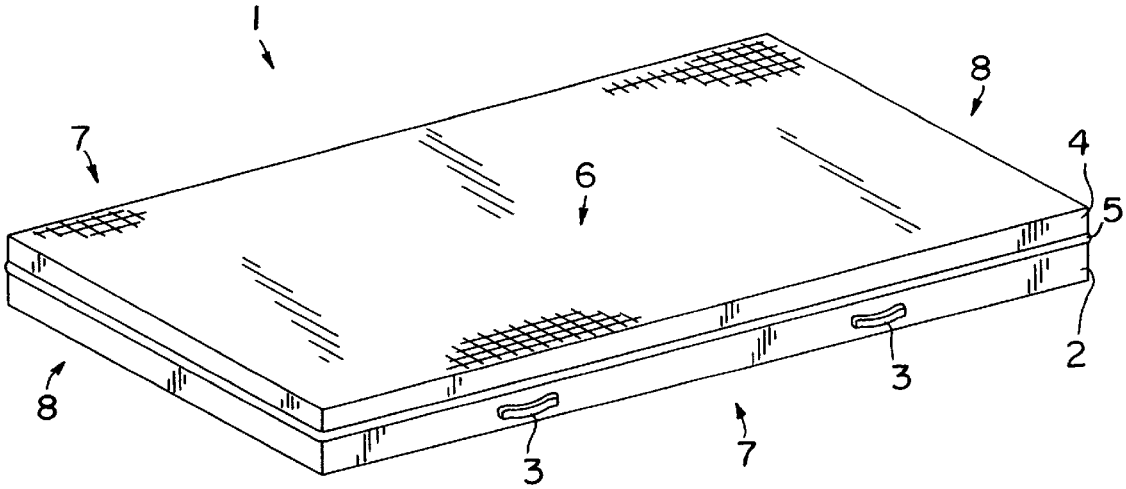
FIG. 1 is perspective view of a mattress assembly according to one embodiment of the present invention.

FIG. 1 is a perspective view of a mattress assembly according to one embodiment of the present invention. As shown in FIG. 1, the mattress assembly 1 of the present invention forms a "stand-alone" structure which can be positioned and supported on a bed frame or table. As "assembled" in FIG. 1, the elements of the mattress assembly 1 which are visible include a base assembly 2 having handles 3 and a top coverlet 4. The base assembly 2 and top coverlet 4 can be coupled together along periphery or side edges by a zipper 5. The top coverlet 4 provides an upwardly facing sleeping surface 6 configured to support a patient.

The mattress assembly 1 includes longitudinally extending, transversely spaced-apart sides 7 and transversely extending, longitudinally spaced-apart ends 8 as shown in FIG. 1. Sides 7 of mattress assembly 1 are longer than ends 8. Thus, mattress assembly 1 has a rectangular shape. However, the present invention is applicable to mattresses which have other than rectangular shapes.

Figure 2:
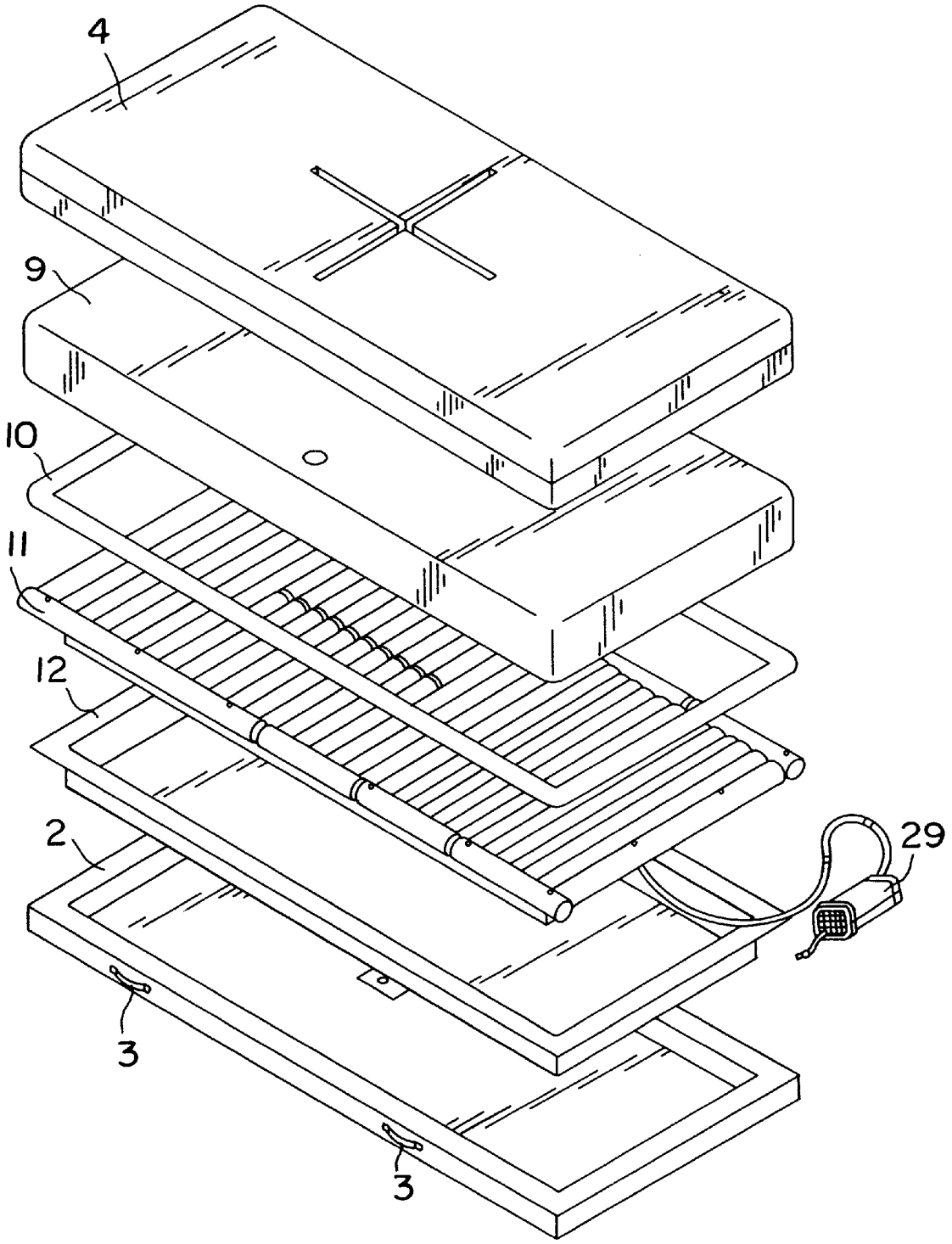
FIG. 2 is an exploded perspective view of a mattress assembly according to one embodiment of the present invention.

FIG. 2 is an exploded perspective view of a mattress assembly according to one embodiment of the present invention. The mattress assembly 1 includes a number of elements which are received between the top coverlet 4 and the base assembly 2. These intermediate elements include inner cover 9, perimeter inflater 10, air-over-foam core structure 11, and bottom storage cover 12.

Figure 3:
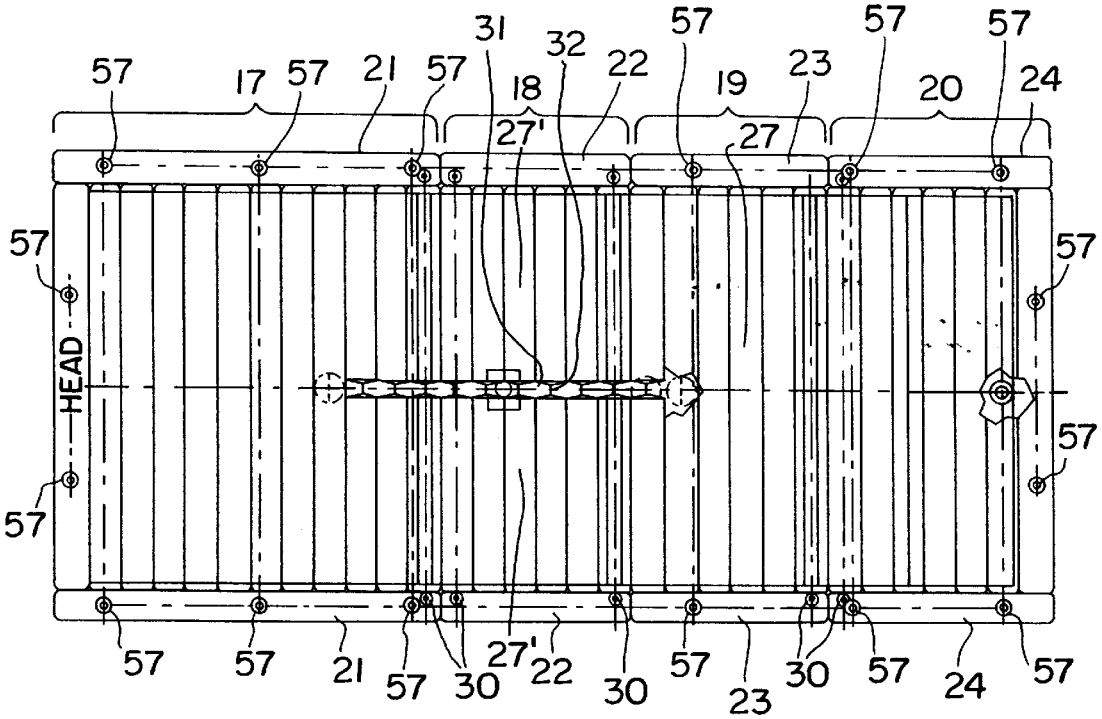
FIG. 3 is a top plan view of the air-over-foam core structure of the mattress assembly of FIG. 2.
Figure 4:
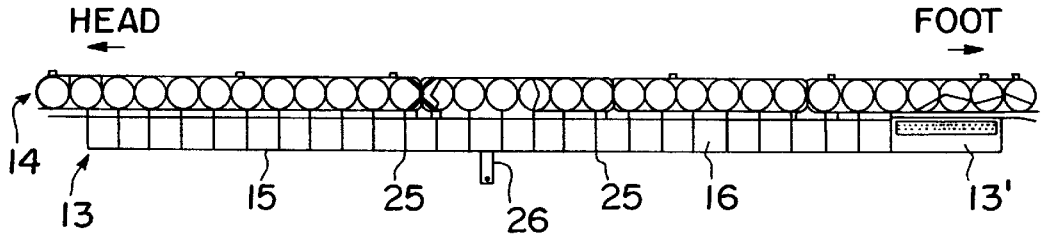
FIG. 4 is a side elevation view of the air-over-foam core structure of the mattress assembly of FIG. 4.

FIG. 3 is a top plan view of the air-over-foam core structure of the mattress assembly of FIG. 2. FIG. 4 is a side elevation view of the air-over-foam core structure of the mattress assembly of FIG. 3. The air-over-foam core structure 11 includes a plurality of lower support elements 13 and a plurality of upper support elements 14 which are supported by the lower support elements 13 as depicted in FIG. 4. The lower support elements 13 are transversely extending foam blocks and the upper support elements 14 are somewhat cylindrically shaped air bladders. Hereinafter, the lower support elements 13 will be referred to as foam blocks 13 and the upper support elements 14 will be referred to as air bladders 14. The air-over-foam core structure 11 further includes a layer of material 15 that underlies foam blocks 13.

The air bladders 14 and foam blocks 13 of the air-over-foam core structure 11 are secured to the layer of material 15 as will now be described. Air-over-foam core structure 11 includes a plurality of square-shaped sleeves 16, each of which includes an interior region and each of which are anchored to layer of material 15 by, for example, radio frequency (RF) welding. Each sleeve 16 includes open ends that allow foam blocks 13 to be inserted into interior region of the respective sleeves 16. Each foam block 13 includes a top surface, a bottom surface, a pair of side surfaces extending between top and bottom surfaces and a pair of end surfaces extending between top and bottom surfaces. Each sleeve 16 includes a top panel, a bottom panel, and a pair of side panels extending between top and bottom panels.

Sleeves 16 are sized so that foam blocks 13 fit snugly within their interior regions. Thus, top, bottom, and side panels of sleeves 16 engage top, bottom, and side surfaces of foam blocks 13, respectively. Engagement between panels of the sleeves 16 and surfaces of the foam blocks 13 causes foam blocks 13 to resist transverse shifting within sleeves 16. In addition, securing sleeves 16 to layer of material 15 prevents longitudinal shifting of foam blocks 13. Thus, sleeves 16 hold foam blocks 13 in their respective positions relative to layer of material 15. The length of foam blocks 13 is such that foam blocks 13 extend substantially between sides 7 of mattress assembly 1 and the length of each sleeve 16 is substantially equivalent to the length of foam blocks 13 so that the end surfaces of foam blocks 13 are aligned with open ends of sleeves 16. Each sleeve 16 is made from a material having a low coefficient of friction, such as urethane coated nylon twill, to provide foam blocks 13 with an anti-friction shear coating. Layer of material 15 is also made from a material having a low coefficient of friction.

Although sleeves 16 completely surround the surfaces of foam blocks 13, it is within the scope of the invention for air-over-foam core structure 11 to include sleeves 16 that are U-shaped having a top panel and a pair of side panels that extend downwardly from the top panel to attach to layer of material 15 so that bottom surfaces of foam blocks 13 engage layer of material 15. In addition, although each sleeve 16 includes two open ends, it is within the scope of the invention as presently perceived for air-over-foam core structure 11 to include sleeves 16 having only one open end.

The firmness and support characteristics provided by each foam block 13 depend in part upon the indention load deflection (ILD) of the foam from which each foam block is made. The ILD is a well-known industry-accepted index indicating the "firmness" of material such as urethane foam and other foam rubber materials. The ILD correlates to the amount of force required to compress a piece of foam by twenty-five percent with an industry standard indenter having a specified area. It is within the scope of the invention as presently perceived to provide air-over-foam core structure 11 in which each foam block 13 has the same ILD or to provide air-over-foam core structure 11 in which the ILD of at least one foam block 13 is different from the ILD of at least one other foam block 13. For example, the ILD's of the foam blocks 13 15 which support air bladders 14 of respective back, seat, thigh, and foot zones 17, 18, 19, and 20 (FIG. 3) may vary from one another. In addition, it is within the scope of the present invention for each foam block 13 to be comprised of portions having varying ILD's.

According to one embodiment the air-over-foam core structure 11 can be provided with foam blocks 13 each having firm end portions with an ILD of about forty-four and a soft middle portion with an ILD of about seventeen. The firm end portions can be sized so as to support the respective overlying header bladders 21, 22, 23, and 24 to provide a mattress structure having more firmness along sides thereof. The end portions of the foam blocks 13 can be bonded to respective middle portions with an adhesive such as, for example, an acetone heptane and resin base spray.

Air-over-foam core structure 11 includes a plurality of tethers 25 that connect respective transversely extending air bladders 14 to layer of material 15. Tethers 25 extend downwardly from air bladders 14 between side panels of respective pairs of sleeves 16 and attach to layer of material 15 by, for example, RF welding. The tethers 25 can be formed integrally with transversely extending air bladders 14. Alternatively, the tethers 25 can be separate pieces that attach to both the air bladders 14 and the layer of material 15.

The tethers 25 can be made of an anti-friction shear material having a low coefficient of friction, such as urethane coated nylon twill. Each pair of adjacent sleeves 16 can contact tethers 25 positioned therebetween. Because sleeves 16 and tethers 25 are made of an anti-friction shear material having a low coefficient of friction, the foam blocks 13 and associated sleeves 16 are able to compress and uncompress with a minimal amount of friction being created by tethers 25. In addition, air bladders 14 can be made of an anti-friction shear material having a low coefficient of friction which allows air bladders 14 to compress and uncompress with a minimal amount of friction therebetween. The minimal amount of friction between sleeves 16 and tethers 25 allows each foam block 13 to compress and uncompress individually with minimal interference from adjacent foam blocks 13. Similarly, the minimal amount of friction between air bladders 14 allows each air bladder 14 to compress and uncompress individually with minimal interference from adjacent air bladders 14.

Securing foam blocks 13 and air bladders 14 to layer of material 15 allows air-over-foam core structure 11 to be moved as a single unit with foam blocks 13 and air bladders 14 remaining held in the proper positions relative to one another and relative to layer of material 15.

Air-over-foam core structure 11 defines a mattress structure that may be used with a bed or table including an articulating deck (not shown) having pivotable head, seat, thigh, and leg sections. As the deck articulates, the mattress structure bends along with the deck sections. In the mattress assembly 1, top coverlet 4 includes an upper surface that frictionally engages a user lying on sleep surface 6 so that, when mattress structure bends during articulation of the deck, top coverlet 4 tends to move with the user rather than moving with air-over-foam core structure 11. Thus, providing shear inner cover 9 between top coverlet 4 and air-over-foam core structure 11 minimizes the rubbing of mattress structure against the user during articulation of the deck.

As indicated in FIG. 3, one or more air bladders 14 can extend beyond the last foam block 13 at the "head" and/or "foot" end of the air-over-foam core structure. At the "foot" end of the air-over-foam core structure, a foam block 13' having an extended width can be used.

The foam block and bladder construction facilitates folding the resulting mattress structure for shipping or storage. In this regard, the plurality of laterally extending foam blocks 13 in mattress structure define fold locations between each adjacent foam block 13, thus the mattress structure may be folded in many different ways.

Air bladders 14 of air-over-foam core structure 11 include a pair of back section header bladders 21, a pair of seat section header bladders 22, a pair of thigh section header bladders 23, and a pair of foot section header bladders 24. Header bladders 21, 22, 23, and 24 extend longitudinally relative to mattress structure defined by the air-over-foam core structure 11 and are arranged in end-to-end relation along respective sides of air-over-foam core structure 11 as shown best in FIG. 3. Header bladders 21, 22, 23, and 24 each include a cylindrical portion and a pair of end portions. The rest of the plurality of air bladders 14 extend transversely between respective header bladders 21, 22, 23, and 24 and are arranged in side-by-side relation between ends of air-over-foam core structure 11. Each of the transversely extending air bladders 27 includes a cylindrical portion and a pair of end portions. Each end portion of the transversely extending air bladders 27 is attached to respective cylindrical portions of the associated header bladder 21, 22, 23, and 24, for example, by RF welding. A fluid port (not shown) is formed through each end portion of the transversely extending air bladders 27 and through the respective cylindrical portion of the associated header bladder 21, 22, 23, and 24 so that an interior region of each header bladder 21, 22, 23, and 24 is in fluid communication with an interior region of each of the transversely extending air bladders 27 attached thereto.

Header bladders 21, 22, 23, and 24 and the transversely extending air bladders 27 associated therewith are sized so as to be supported by the respective deck sections of the articulating deck with which mattress structure is used. Thus, back section header bladders 21 and the associated transversely extending air bladders 27 provide the mattress structure with a back zone 17, shown in FIG. 3, which is supported by the underlying foam blocks 13 and the back section of the articulating deck. Similarly, seat, thigh, and foot section header bladders 22, 23, and 24 and the associated transversely extending air bladders 27 provide the mattress structure with seat, thigh, and foot zones 18, 19, and 20, respectively, which are supported by respective underlying foam blocks 13 and the seat, thigh, and foot sections, respectively, of the articulating deck.

The mattress structure defined by the air-over foam core structure 11 includes a plurality of air tubes 28 that are routed to each of header bladders 21, 22, 23, and 24. The air tubes 28 are lead out from the mattress assembly 1 (FIG. 2) and connected to an air pressure control device 29 (FIG. 2) which includes an air pump or compressor or source of pressurized air, pressure sensors and means to control the inflation and pressure of the air bladders 14.

Air-over-foam core structure 11 may include a plurality of vent valves 30 that can each be manually opened to fluidly couple a respective one of each of header bladders 21, 22, 23, and 24 to the atmosphere which results in rapid deflation of all air bladders 14. In illustrated embodiments, vent valves 30 are VARILITE® release valves, Model No. 04227, and hat flanges Model No. 04226.

A gap 31 is provided in the array of air bladders 14. The gap 31 is position centrally along the lateral direction of the air-over foam core structure 11 in the seat section 18. The gap 31 is formed by including two half air bladders 27' for each of the air bladders 27 in the seat section 18 with a space or gap 31 located between respective half air bladders 27'. In addition to utilizing half air bladders 27' in the seat section 18, one or more of the adjacent air bladders 27 in the head section 17 and/or the thigh section 19 can be used to extend the gap 31 into these sections. Tethers 32 located between the ends of the half air bladders 27' and layer of material 15 can be used to maintain the relative position of the half air bladders 27'. The gap 31 in the array of air bladders 27' allows the drain pipe 44 and/or drain trough 37 of the drain assembly 43 to pass through the air-over foam core structure 11. A similar gap can be provided in the underlying foam blocks to allow drain pipe 44 of drain trough 37 to extend therethrough. For example, according to one embodiment of the present invention, the foam block(s) which are located directly beneath the drain pipe 44 of drain trough 37 can include a through-hole or can be made of two half-block portions having a space or gap therebetween through which the drain pipe 44 or a drain connection can extend.

As indicated in FIG. 4, the air-over foam core structure 11 includes four tether straps 26 (one shown) which are used to attach or anchor corresponding tether tabs 41 which are provided on the drain trough 37 as discussed below. Tether straps 26 can be connected to layer of material 15 directly or via vertical web elements. Tether straps 26 are positioned to be aligned with the ends of drain trough 37 and can include grommets which can be coupled to grommets 42 of the corresponding tether tabs 41 of drain trough 37 by tie elements, such as locking ties.

Figure 5:
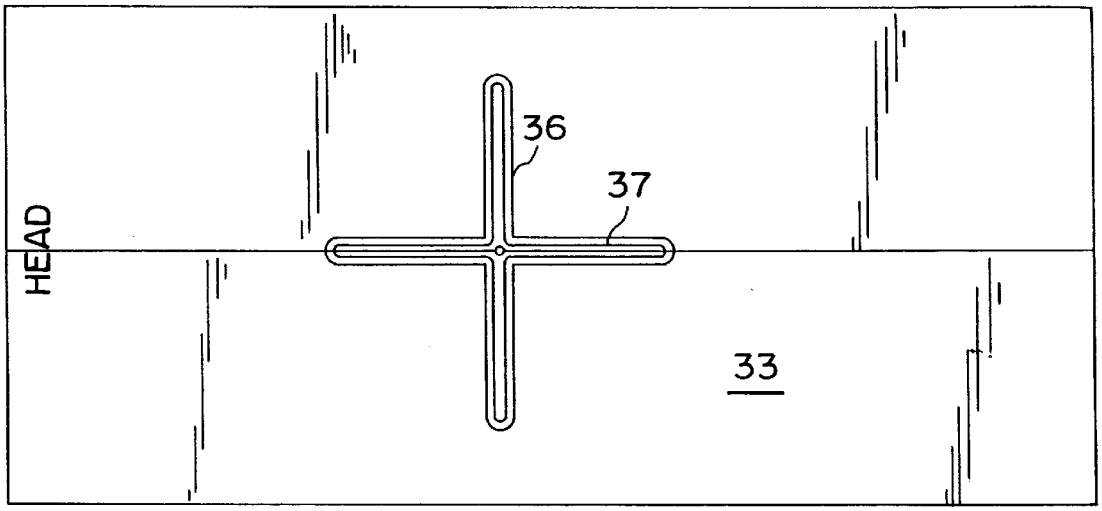
FIG. 5 is a top plan view of the top coverlet of the mattress assembly of FIG. 2.
Figure 6:
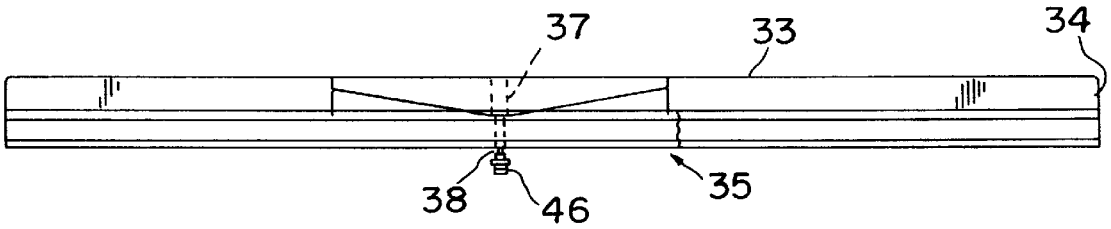
FIG. 6 is a side elevation view of the top coverlet of the mattress assembly of FIG. 5.
Figure 7:
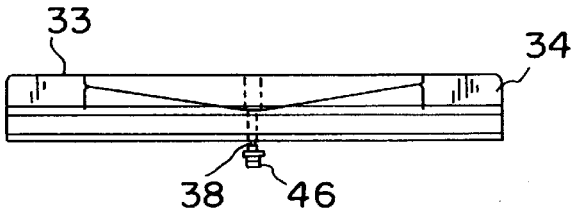
FIG. 7 is an end elevation view of the top coverlet of the mattress assembly of FIG. 5.

FIG. 5 is a top plan view of the top coverlet of the mattress assembly of FIG. 2. FIG. 6 is a side elevation view of the top coverlet of the mattress assembly of FIG. 5. FIG. 7 is an end elevation view of the top coverlet of the mattress assembly of FIG. 5. The top coverlet 4 includes a top panel 33 and peripheral side panels 34 extending downwardly from top panel 33. Top panel 33 cooperates with side panels 34 to define an interior region 35 which receives the inner cover 9, which is in turn positioned over the air-over-foam core structure 11.

The top panel 33 includes a cross slit 36 which is positioned centrally along the lateral direction of the mattress assembly 1 and over the seat section 18 of the mattress assembly 1. The cross slit 36 includes an axis which is aligned with the longitudinal axis of the mattress assembly 1. The cross slit 36 is sized to receive a drain trough 37. As depicted in FIGS. 6 and 7, the drain trough 37 extends below top panel 33 and includes a drain 38 which extends beneath the bottom edges of side panels 34.

The top coverlet 4 is preferably made of a fabric which has been treated to be water impermeable and which has a low coefficient of friction, such as urethane coated nylon.

Figure 8:
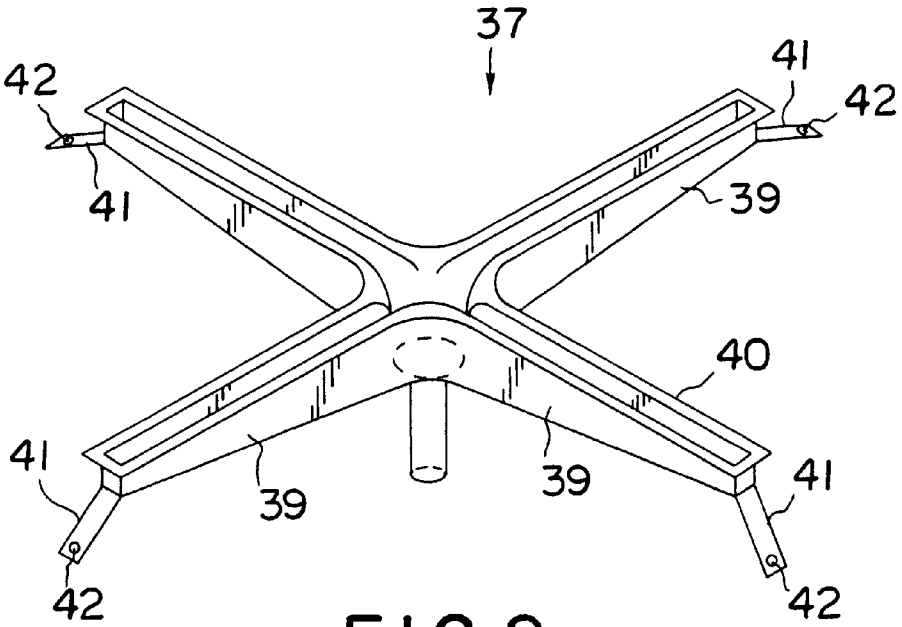
FIG. 8 is a perspective view of the trough and drain assembly of FIGS. 5–7.

FIG. 8 is a perspective view of the trough and drain assembly of FIGS. 5–7. The drain trough 37 includes four arm portions 39 which form a cross-shaped structure. A continuous flange 40 extends outwardly from the upper edges of the arm portions 39. As discussed below, flange 40 is used to couple the drain trough 37 to the top panel 33 of the top coverlet 4. The bottoms of the arm portions 39 slope downward toward the center of the drain trough 37 as depicted in FIGS. 6 and 7. The ends of the arm portions 39 of the drain trough 37 include tether tabs 41 which extend from bottom surfaces thereof. Tether tabs 41 include grommets 42 which, as discussed above, can be coupled to corresponding grommets in tether straps 26 and used to attach or anchor drain trough 37 to air-over-foam core structure 11.

Figure 9:
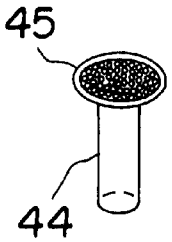
FIG. 9 is a perspective view of the drain assembly of FIG. 8.

FIG. 9 is a perspective view of the drain assembly of FIG. 8. The drain assembly 43 includes a drain tube or pipe 44 which extends from drain head 45. The drain head 45 is coupled to the bottom of the drain trough 37 as indicated in FIG. 8 so that fluids which are collected in the drain trough 37 can flow down the sloped bottoms of the arm portions 39 and into and through the drain assembly 43. As depicted in FIGS. 6 and 7, the drain assembly 43 can have a fitting 46 on the drain pipe 44 by which the drain assembly 43 can be coupled to drain line (not shown) which extends beneath the mattress assembly 1.

Figure 10:
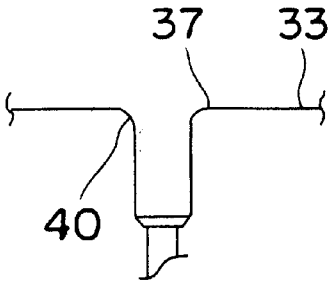
FIG. 10 is a cross-sectional view which depicts one manner of coupling the trough and drain assembly to the top coverlet.

FIG. 10 is a cross-sectional view which depicts one manner of coupling the drain trough and drain assembly to the top coverlet. The drain trough 37 can be coupled to the top panel 33 of the top coverlet 4 by inserting the drain trough 37 into slit 36 until the flange 40 of the drain trough 37 contacts the top panel 33. The overlapping edge of the flange 40 and the peripheral edge of the slit 36 can be bonded together by RF welding or other suitable means, including gluing.

Figure 12:
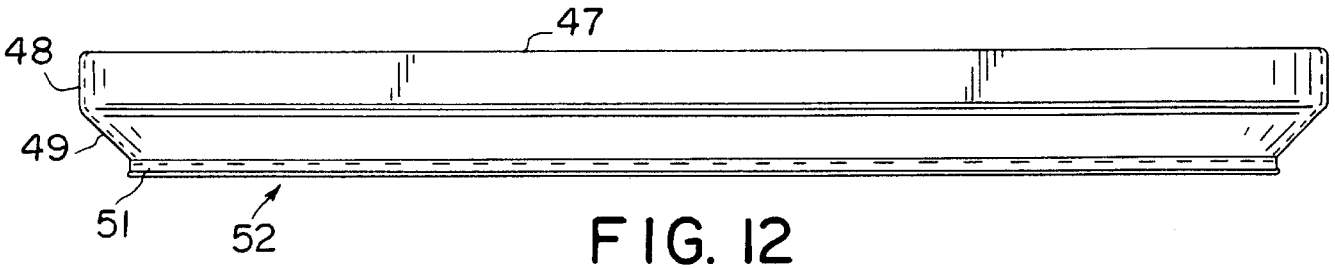
FIG. 12 is a side elevation view of the inner cover of the mattress assembly of FIG. 11.
Figure 11:
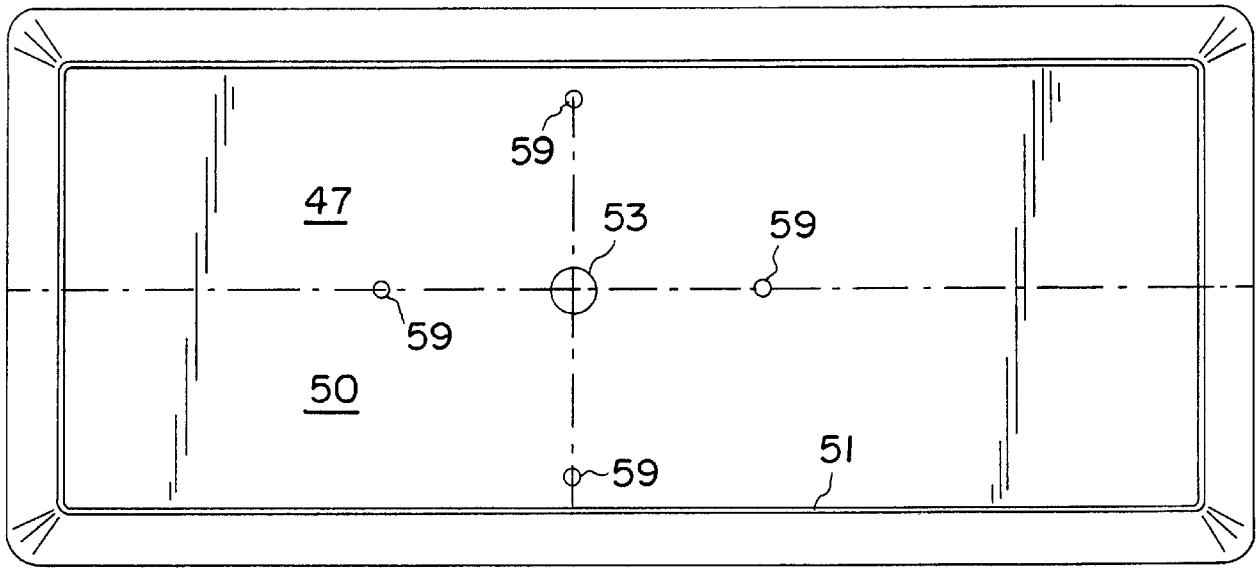
FIG. 11 is a bottom plan view of the inner cover of the mattress assembly of FIG. 2.
Figure 13:
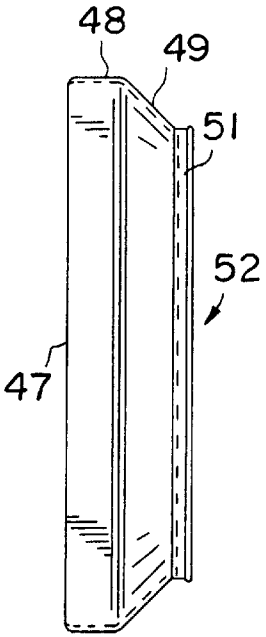
FIG. 13 is an end elevation view of the inner cover of the mattress assembly of FIG. 11.

FIG. 11 is a bottom plan view of the inner cover of the mattress assembly of FIG. 2. FIG. 12 is a side elevation view of the inner cover of the mattress assembly of FIG. 11. FIG. 13 is an end elevation view of the inner cover of the mattress assembly of FIG. 11. Inner cover 9 includes a top panel 47, peripheral side panels 48 extending downwardly from top panel 47, and a fitted portion 49 appended to side panels 48 and extending at least partially beneath top panel 47. Top panel 47 cooperates with side panels 48 and fitted portion 49 to define an interior region 50 which receives air-over-foam core structure 11. Fitted portion 49 includes an inner peripheral edge 51 defining an opening 52 beneath top panel 47 allowing for movement of air-over-foam core structure 11 into and out of interior region 50 of inner cover 9. In the illustrated embodiments, inner peripheral edge 51 of fitted portion 49 can be provided with either an elastic band or draw string or other suitable structure for drawing opening 52 of fitted portion 49 closed to facilitate wrapping inner cover 9 snugly around air-over-foam core structure 11. The inner cover 9 is provided with a through-hole 53 through which drain pipe 44 of the drain assembly 43 can pass. In addition, four through-holes 59 are provided in inner cover 9 through which tether tabs 41 or drain trough 37 can pass so as to couple drain trough 37 to air-over-foam core structure 11.

Inner cover 9 is made from a material having a low coefficient of friction such as "parachute" material or any other material that will allow top coverlet 4 to slide relative to air-over-foam core structure 11. In the illustrative embodiment, inner cover 9 may be made from nylon rip stop 30 denier, style #66938 or 1.5 mil polyurethane material. Top coverlet 4 can be made from any of a number of materials, but, in illustrated embodiments, top coverlet 4 is made from DARTEX™ TC-23/PO-93 urethane coated nylon fabric which allows for wipe-down cleaning. Bottom storage cover 12 is made from STAPH-CHEK® or WEBLON® reinforced vinyl laminate.

Figure 14:
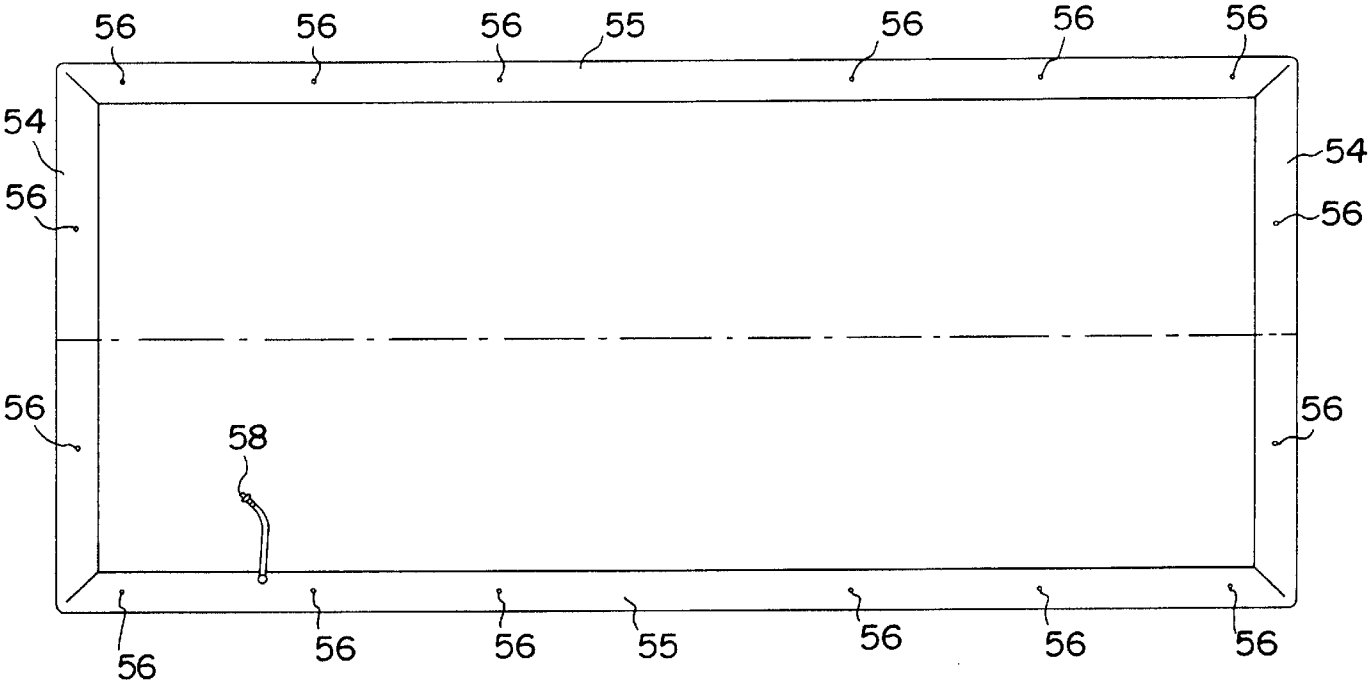
FIG. 14 is a top plan view of the perimeter inflater of the mattress assembly of FIG. 2.
Figure 15:
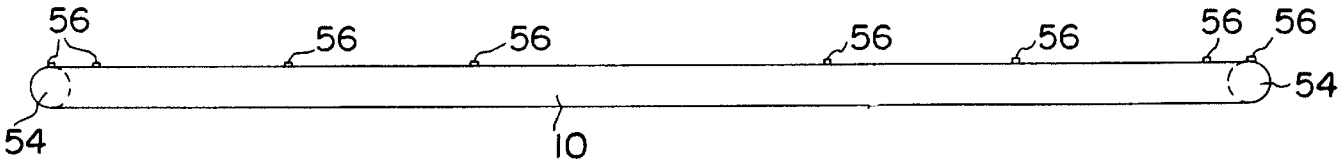
FIG. 15 is a side elevation view of the perimeter inflater of the mattress assembly of FIG. 14.
Figure 16:
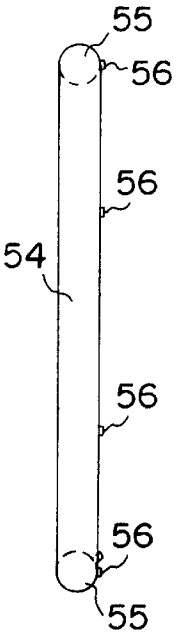
FIG. 16 is an end elevation view of the perimeter inflater of the mattress assembly of FIG. 14.

FIG. 14 is a top plan view of the perimeter inflater of the mattress assembly of FIG. 2. FIG. 15 is a side elevation view of the perimeter inflater of the mattress assembly of FIG. 14. FIG. 16 is an end elevation view of the perimeter inflater of the mattress assembly of FIG. 14. The perimeter inflater 10 includes two end air bladders 54 and two side air bladders 55 which are coupled together to form a rectangular bladder which has a continuous internal fluid passageway. The bottoms of the end and side air bladders 54, 55 are provided with a plurality of snap portions 56 which are arranged to be aligned with corresponding snap portions 57 provided on the header bladders 21, 22, 23, and 24 of the air-over-foam core structure 11. The snap portions 56, 57 are used to couple the perimeter inflater 10 to the air-over-foam core structure 11. The perimeter inflater 10 is shaped and dimensioned to overlay header bladders 21, 22, 23, and 24.

The perimeter inflater 10 includes an air tube 58 which communicates with the interior thereof and which can be used to inflate and regulate fluid pressure within the perimeter inflater 10. The air tube 58 can be coupled to air pressure control device 29 or to an additional, separate air pressure control device.

When the mattress assembly is used, the perimeter inflater 10 can be inflated to raise the peripheral edges of inner cover 9 and top coverlet 4 upward to contain fluids on the surface of the top coverlet 4 and to direct such fluids toward the drain trough 37. Fluids which pass through drain trough 37 can be collected in a suitable waste container via gravity or suction. A constant low volume suction force can be applied to contain odors as well as fluids. A suitable waste container can be located beneath the bed assembly. Otherwise, non-hazardous fluids could be directed into an underground sewage system.

Figure 17:
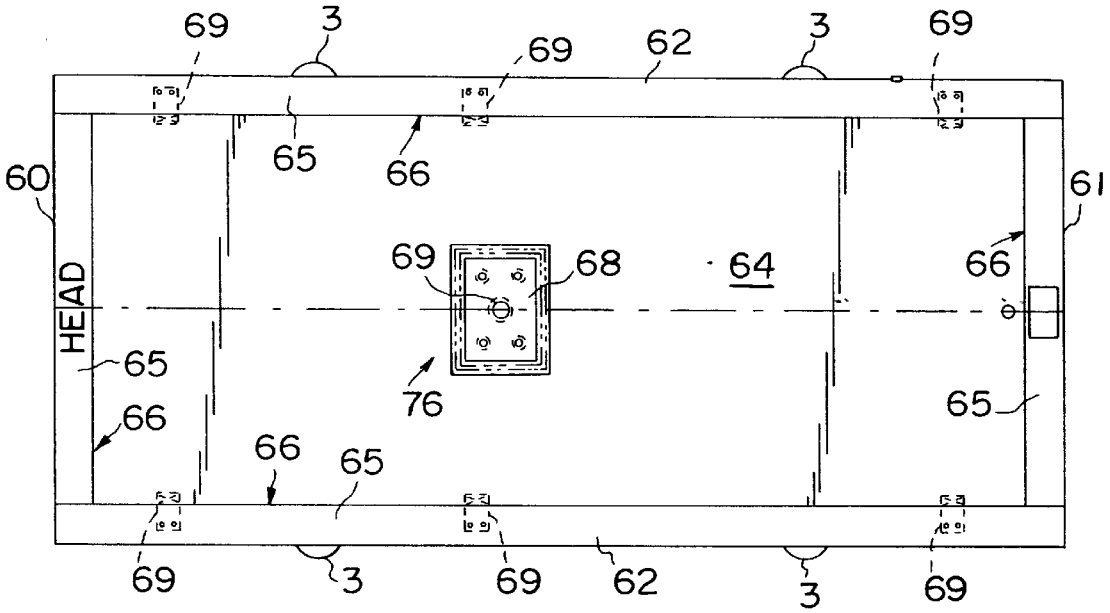
FIG. 17 is a top plan view of the base assembly of the mattress assembly of FIG. 2.
Figure 18:
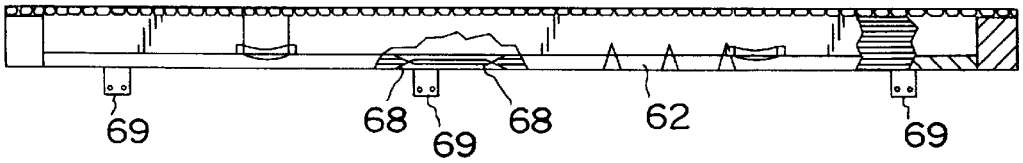
FIG. 18 is a side elevation view of the base assembly of the mattress assembly of FIG. 17.
Figure 19:
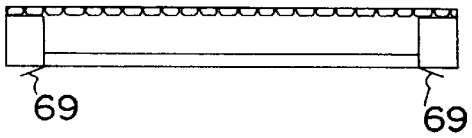
FIG. 19 is an end elevation view of the base assembly of the mattress assembly of FIG. 17.

FIG. 17 is a top plan view of the base assembly of the mattress assembly of FIG. 2. FIG. 18 is a side elevation view of the base assembly of the mattress assembly of FIG. 17. FIG. 19 is an end elevation view of the base assembly of the mattress assembly of FIG. 17. The base assembly 2 includes a head end member 60, a foot end member 61 longitudinally spaced-apart from the head end member 60, and transversely spaced-apart side members 62 which are attached to each of the head and foot end members 60, 61. Each of the head and foot end members 60, 61 and the side members 62 are appended to a foam base 63, and each includes inwardly facing side surfaces. The foam base 63 includes a top surface 64. Each of the head and foot end members 60, 61 and the side members 62 have upper surfaces which collectively define a continuous rectangular top surface 65.

The foam base can be made of from relatively stiff foam rubber such as, for example, foam rubber having an ILD of 44, and end members 60, 61 and side members 62 are likewise preferably made from foam rubber having an ILD of 44 to provide mattress assembly 1 with relatively firm firmness and support characteristics around the perimeter thereof. Providing a base assembly 2 having relatively firm firmness and support characteristics around the perimeter of mattress assembly 1 will assist the user when entering or exiting sleeping surface 6 of mattress assembly 1.

When air-over foam core structure 11 is received in base assembly 2, bottom surface of the air-over-foam core structure 11 engages top surface 64 of base assembly 2. Thus, base assembly 2 includes side members 62 and end members 60, 61 that extend upwardly from top surface 64 of foam base 63 and include inwardly-facing side surfaces 66 engaging air-over-foam core structure 11 to prevent the air-over-foam core structure 11 from moving longitudinally or laterally relative to base assembly 2. Likewise, air-over-foam core structure 11 is configured to conformingly nest in base assembly 2.

The base assembly 2 includes a drain assembly 76 which includes upper and lower plates 68 (see FIG. 18) which can be coupled together by suitable mechanical fasteners such as screws or bolts. The upper and lower plates 68 can include aligned through-holes 80 which are sized to receive a drain line connected to drain fitting 46 therethrough.

Handles 3 can be provided on the peripheral sides and ends of the base assembly 2 and used to lift the base assembly 2. A plurality of anchoring straps 69 are provided along the bottom peripheral edge of the base assembly 2. Anchoring straps 69 can be used to secure the base assembly 2 to the frame or support surface of a bed, cart, table, or other support device.

An anti-skid pad (not shown) can be RF welded, stitched, bonded, or otherwise appropriately attached to a portion of or the entire central region of the bottom of base assembly 2. Such an anti-skid pad will function to frictionally engage the bed or table (not shown) on which mattress assembly 1 is used to inhibit movement of mattress assembly 1 relative to the bed or table, especially during articulation of the deck. Such an anti-skid pad can be made from textured rubber or other materials which would increase the frictional forces between the mattress assembly 1 and the bed or table.

Figure 20:
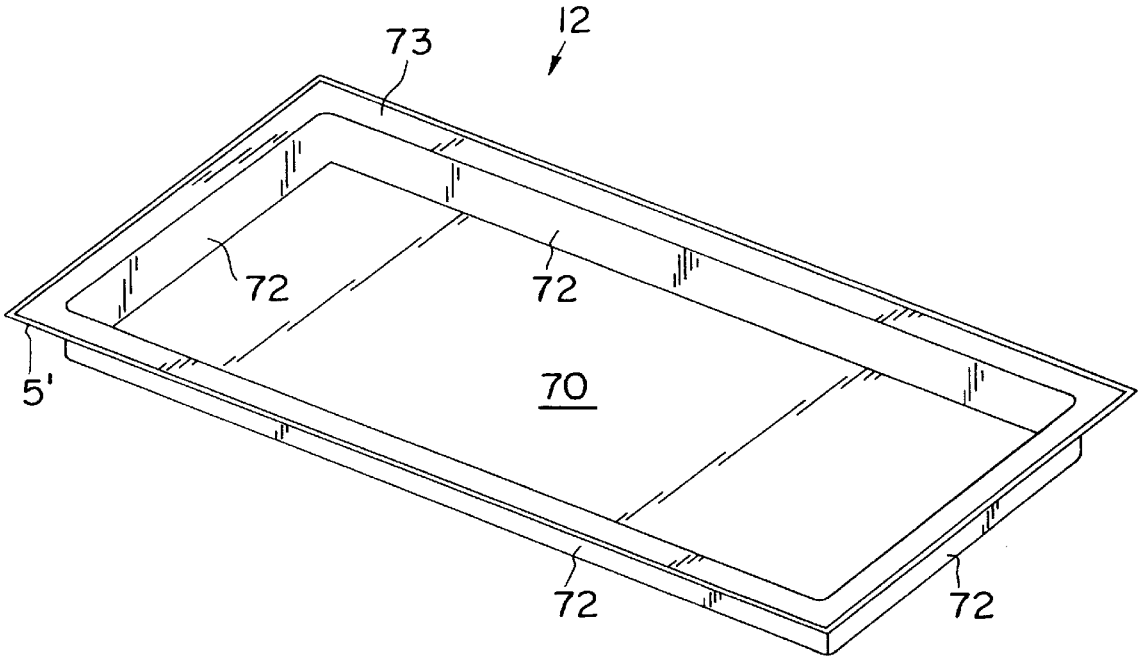
FIG. 20 is a perspective view of the bottom storage cover of the mattress assembly of FIG. 2.

FIG. 20 is a perspective view of the bottom storage cover of the mattress assembly of FIG. 2. The bottom storage cover 12 is not part of actual mattress assembly 1 and is not received in interior region of mattress assembly depicted in FIG. 1. Instead, bottom storage cover 12 cooperates with top coverlet 4 to define a storage cover for protecting mattress assembly 1 during storage. Bottom storage cover 12 includes a peripheral zipper 5' that engages zipper 5 on top coverlet 4 to attach bottom storage cover 12 to top coverlet 4.

Bottom storage cover 12 includes a bottom panel 70 having a generally rectangular peripheral sides 72 extending upwardly from the bottom panel 70, and a generally horizontal flange 73 extending outwardly from sides 72. Flange 73 includes a generally rectangular outer peripheral edge and zipper 5' is attached to the edge of flange 73 as shown.

Once mattress assembly 1 is received in the interior region of bottom storage cover 12 and zipper 5' is closed in cooperation with zipper 5 to attach bottom storage cover 12 to top coverlet 4, mattress assembly 1 can be easily stored and a different mattress core (not shown) can be used with base assembly 2.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A hydrotherapy mattress comprising:

a mattress core;

a base configured to receive the mattress core;

a top cover located over the mattress core and configured to provide a patient receiving surface, the top cover including an outer perimeter edge;

a drain configured to extend through the top cover and the mattress core to drain fluids from the top cover; and a bladder located on the mattress core adjacent the outer perimeter edge of the top cover, the bladder being selectively inflatable to elevate a portion of the top cover adjacent the outer perimeter edge so that fluids on the patient receiving surface of the top cover are contained on the top cover and directed toward the drain.

2. The hydrotherapy mattress of claim 1, wherein the mattress core comprises a plurality of foam core elements; and an array of air bladders supported on the plurality of foam core elements.

3. The hydrotherapy mattress of claim 2, wherein the array of air bladders includes a plurality of header air bladders which are arranged on opposite sides of the mattress core, and a plurality of transverse air bladders which extend between the header air bladders.

4. The hydrotherapy mattress of claim 1, wherein the base is formed to include a drain passage to permit the drain to pass through the base.

5. The hydrotherapy mattress of claim 1, further comprising an inner cover positioned between the mattress core and the top cover.

6. The hydrotherapy mattress of claim 5, wherein the inner cover is made from a material having a low coefficient of friction.

7. The hydrotherapy mattress of claim 1, further comprising a drain trough including a plurality of elongated arm portions coupled to the top cover, each of the plurality of elongated arm portions being in fluid communication with the drain and configured to extend outwardly from the drain to facilitate drainage of fluids from the top cover into the drain.

8. The hydrotherapy mattress of claim 7, wherein the drain trough includes four arm portions which are configured to form a cross-shaped structure.

9. The hydrotherapy mattress of claim 8, wherein the four arm portions each have a bottom surface configured to slope toward a center of the drain.

10. The hydrotherapy mattress of claim 1, wherein the top cover is liquid impervious.

11. The hydrotherapy mattress of claim 1, wherein the mattress core includes a plurality of elongated side-by-side bladders configured to provide a substantially continuous support for a patient, at least two of the bladders being configured to define an opening extending in a direction transverse to the plurality of bladders, and further comprising drain trough having a first elongated trough section located between two adjacent bladders and a second elongated trough section located in the opening, the second elongated trough section being configured to intersect the first elongated trough section, the first and second elongated trough sections both being coupled to the top cover and configured to drain fluid from the top cover into the drain while maintaining the substantially continuous support of the mattress core.

12. A hydrotherapy mattress comprising:

a mattress core including a plurality of elongated side-by-side bladders configured to provide a substantially continuous support for a patient, at least two of the bladders being configured to define an opening extending in a direction transverse to the plurality of bladders;

a base configured to receive the mattress core;

a top cover located over the mattress core and configured to provide a patient receiving surface; and a drain configured to extend through the top cover and the mattress core, the drain including a drain trough having a first elongated trough section located between two adjacent bladders and a second elongated trough section located in the opening, the second elongated trough section being configured to intersect the first elongated trough section, the first and second elongated trough sections both being coupled to the top cover and configured to drain fluid from the top cover into the drain while maintaining the substantially continuous support of the mattress core.

13. The hydrotherapy mattress of claim 12, further comprising a bladder located on the mattress core adjacent an outer perimeter edge of the top cover, the bladder being selectively inflatable to elevate a portion of the top cover adjacent the outer perimeter edge so that fluids on the patient receiving surface of the top cover are contained on the top cover and directed toward the drain.

14. The hydrotherapy mattress of claim 12, wherein the mattress core includes a plurality of foam core elements located below the plurality of elongated side-by-side bladders.

15. The hydrotherapy mattress of claim 12, wherein the bladders includes a plurality of header bladders which are arranged on opposite sides of the mattress core, and a plurality of transverse bladders which extend between the header bladders.

16. The hydrotherapy mattress of claim 12, wherein the base is formed to include a drain passage to permit the drain to pass through the base.

17. The hydrotherapy mattress of claim 12, further comprising an inner cover positioned between the mattress core and the top cover.

18. The hydrotherapy mattress of claim 12, wherein the drain trough includes four arm portions which configured to form a cross-shaped structure.

19. The hydrotherapy mattress of claim 18, wherein the four arm portions each have a bottom surface configured to slope toward a center of the drain.

20. A hydrotherapy mattress comprising:

a mattress core;

a base configured to receive the mattress core;

a top cover located over the mattress core and configured to provide a patient receiving surface;

a drain configured to extend through the mattress core; and a drain trough including a plurality of elongated arm portions coupled to the top cover, each of the plurality of elongated arm portions being in fluid communication with the drain and configured to extend outwardly from the drain to facilitate drainage of fluids from the top cover into the drain.

21. The hydrotherapy mattress of claim 20, wherein the mattress core includes a plurality of elongated side-by-side bladders configured to provide a substantially continuous support for a patient, at least two of the bladders being configured to define an opening extending in a direction transverse to the plurality of bladders, and the drain trough includes a first elongated arm portion located between two adjacent bladders and a second elongated arm portion located in the opening, the first and second elongated arm portions both being coupled to the top cover and configured to drain fluid from the top cover into the drain while maintaining the substantially continuous support of the mattress core.

22. The hydrotherapy mattress of claim 20, wherein the mattress core comprises a plurality of foam core elements, and an array of air bladders supported on the plurality of foam core elements.

23. The hydrotherapy mattress of claim 22, wherein the array of air bladders includes a plurality of header air bladders which are arranged on opposite sides of the mattress core, and a plurality of transverse air bladders which extend between the header air bladders.

24. The hydrotherapy mattress of claim 20, wherein the base is formed to include a drain passage to permit the drain to pass through the base.

25. The hydrotherapy mattress of claim 20, further comprising an inner cover positioned between the mattress core and the top cover.

26. The hydrotherapy mattress of claim 20, wherein the drain trough includes four arm portions configured to form a cross-shaped structure.

27. The hydrotherapy mattress of claim 20, wherein the plurality of elongated arm portions each have a bottom surface configured to slope toward a center of the drain.

28. The hydrotherapy mattress of claim 20, wherein the top cover is liquid impervious.

29. The hydrotherapy mattress of claim 20, wherein the mattress core includes a plurality of elongated side-by-side bladders configured to provide a substantially continuous support for a patient, at least two of the bladders being configured to define an opening extending in a direction transverse to the plurality of bladders, and the drain trough having a first elongated arm portion located between two adjacent bladders and a second elongated arm portion located in the opening, the second elongated arm portion being configured to intersect the first elongated trough section, the first and second elongated arm portions both being coupled to the top cover and configured to drain fluid from the top cover into the drain while maintaining the substantially continuous support of the mattress core.

30. The hydrotherapy mattress of claim 20, further comprising a bladder located on the mattress core adjacent an outer perimeter edge of the top cover, the bladder being selectively inflatable to elevate a portion of the top cover adjacent the outer perimeter edge so that fluids on the patient receiving surface of the top cover are contained on the top cover and directed toward the drain.

* * * * *